United States Patent [19]

Landwehr

[11] 3,980,031

[45] Sept. 14, 1976

[54] TRIMMING MECHANISM FOR SEWING MACHINES

[76] Inventor: Günter Landwehr, Rudolf Virchow Weg 48, 4814 Sennestadt, Germany

[22] Filed: Jan. 27, 1975

[21] Appl. No.: 525,471

[52] U.S. Cl. ..... 112/122; 112/125; 112/219 A

[51] Int. Cl.[2] ..... D05B 37/00

[58] Field of Search ..... 112/122, 123, 124, 125, 112/126, 127, 128, 129, 219 A

[56] References Cited

UNITED STATES PATENTS

| | | | |
|---|---|---|---|
| 2,105,346 | 1/1938 | Card | 112/127 |
| 2,108,138 | 2/1938 | Painter | 112/127 |
| 2,533,197 | 12/1950 | Pinkvoss | 112/125 |

*Primary Examiner*—George H. Krizmanich

[57] ABSTRACT

A trimming mechanism for a sewing machine for cutting the edges of a workpiece in the feeding direction by means of a reciprocating trimmer blade cooperating with a stationary counterknife. While sewing at high speed the trimmer blade is driven by the arm shaft of the sewing machine normally in synchronism with the needle. Drive- and control means are provided for imparting additional up and down movements to the blade when sewing at a low speed and continuation of trimming when the machine is stopped, in order to turn the workpiece about the needle, which is required when changing the sewing direction.

4 Claims, 13 Drawing Figures

TRIMMING MECHANISM FOR SEWING MACHINES

BACKGROUND OF THE INVENTION

This invention relates to a trimming mechanism for sewing machines having a trimming blade, which is forcibly moved up and down by means of the arm shaft, and a sewing machine drive controllable by means of an actuating device for driving the shaft and stopping the same in a predetermined angular position.

There are already known fabric cutting devices for sewing machines, for example from the German Pat. No. 14 85 193, the cutting knife of which is driven by the armshaft of the sewing machine by means of a lifting eccentric, so that the knife cuts at each downstroke, i.e. while the workpiece feed is inoperative. This low frequency of up and down motions of the cutting knife with regard to that of the needle (ratio 1 : 1) is sufficient to obtain properly cut workpiece edges, but only when sewing at a higher speed and when the individual cuts of the knife are formed in straight direction. During cutting of a workpiece, while sewing an outer curve having a small radius, feeding speed of the workpiece is increased at the workpiece edge with regard to the seam to be formed as a consequence of the distance between the needle and the cutting knife. Thus, in order to have the same ratio as required while sewing straight seams, the frequency of the knife motions must be higher than that of the needle motions. However, in conjunction with these known fabric cutting devices, it is impossible to cut the workpiece edge during a standstill of the sewing machine by turning the workpiece about the needle located in the workpiece in lower position, in order to change the sewing direction, since in consequence of the mechanical coupling of the cutting knife to the needle bar drive, the knife is inoperative during standstill of the sewing machine.

In conjunction with a further fabric cutting device for sewing machines known from the German Pat. No. 821 911, U.S. Pat. No. 2,533,197 the cutting knife of which is connected to a shaft causing the up and down motions of the needle, the frequency of the up and down motions of the cutting knife with regard to that of the needle are controlled by a mechanism operated by centrifugal force. Of course, this known fabric cutting device makes it possible at high sewing speed and at each revolution of the armshaft, for the cutting knife and the needle to perform one up and down motion, and, at a reduced speed, to increase the frequency of up and down motions of the cutting knife with regard to that of the needle period. However, also in conjunction with this fabric cutting device it is impossible to cut the workpiece during a standstill of the sewing machine.

Moreover, since, in conjunction with this known fabric cutting device there are arranged belt pulleys with variable diameters between the armshaft of the sewing machine and the drive shaft of the cutting knife, it is probably impossible to control the knife and the needle synchronously at high sewing speed, in order to also actuate the knife at each downstroke of the needle. However, this is required, in order to obtain a properly cut workpiece edge and a minimum wear and tear of the knife at the most favourable frequency ratio of 1 : 1 of the needle and knife motions.

It is also known from the German Pat. No. 647 023, U.S. Pat. No. 2,108,138 to drive the fabric cutting device independently of the needle by means of an electromotor with constant speed, so that the cutting knife can form cutting motions, the frequency of which is changed automatically at different sewing speeds with regard to that of the up and down motions of the needle.

Since the cutting knife is actuated independently of the sewing machine drive, this known fabric cutting device can also be actuated when the sewing machine is stopped, in order to perform the aforesaid cutting cycle when the workpiece is turned about the needle. However, the knife motions are not in synchronism with the needle. The knife also performs cutting motions during the feeding of the workpiece, so that at a ratio of frequency 1 : 1 of the knife motions to the needle motions, an accumulation of the workpiece cannot be avoided in the area of the knife, which is just cutting the workpiece. In order to obtain properly cut edges, the frequency of knife motions must be considerably higher than the knife motions forcibly imparted by the sewing machine drive. However, the high frequency of knife motions in relation to the number of up and down motions of the needle causes a reduced working life of the knife.

It is the primary object of this invention to provide an improved trimming mechanism for use in connection with a sewing machine, which is adapted to trim the lateral edges of a fabric with a minimum of up and down motions of the trimming blade.

It is a further object of this invention to provide a trimming mechanism known from the German Pat. No. 14 85 193 with means for imparting additional up and down motions to the blade when sewing at a lower speed.

Still another object of this invention is to provide the trimming mechanism with means which allow the trimming mechanism to operate during a stillstand of the sewing machine, in order to cut the edge of the workpiece while it is turning about the needle.

A further object of this invention is the provision of simple means for controlling the additional up and down motions of the trimming blade.

SUMMARY

These objects are attained in accordance with the present invention with a trimming mechanism, which includes a trimming blade mounted adjacent to the needle bar of the sewing machine, a stationary counterknife cooperating with the trimming blade, first driving means for imparting up and down motions to the trimming blade as a function of the position of the needle bar, second driving means for imparting up and down motions to the trimming blade, irrespectively of the first driving means, and control means for actuating the second driving means.

The various featurs and advantages of this invention will be apparent from the following description of an embodiment thereof taken in conjunction with the accompanying drawings.

DESCRIPTION OF THE PREFERRED EMBODIMENT

Figure 1:
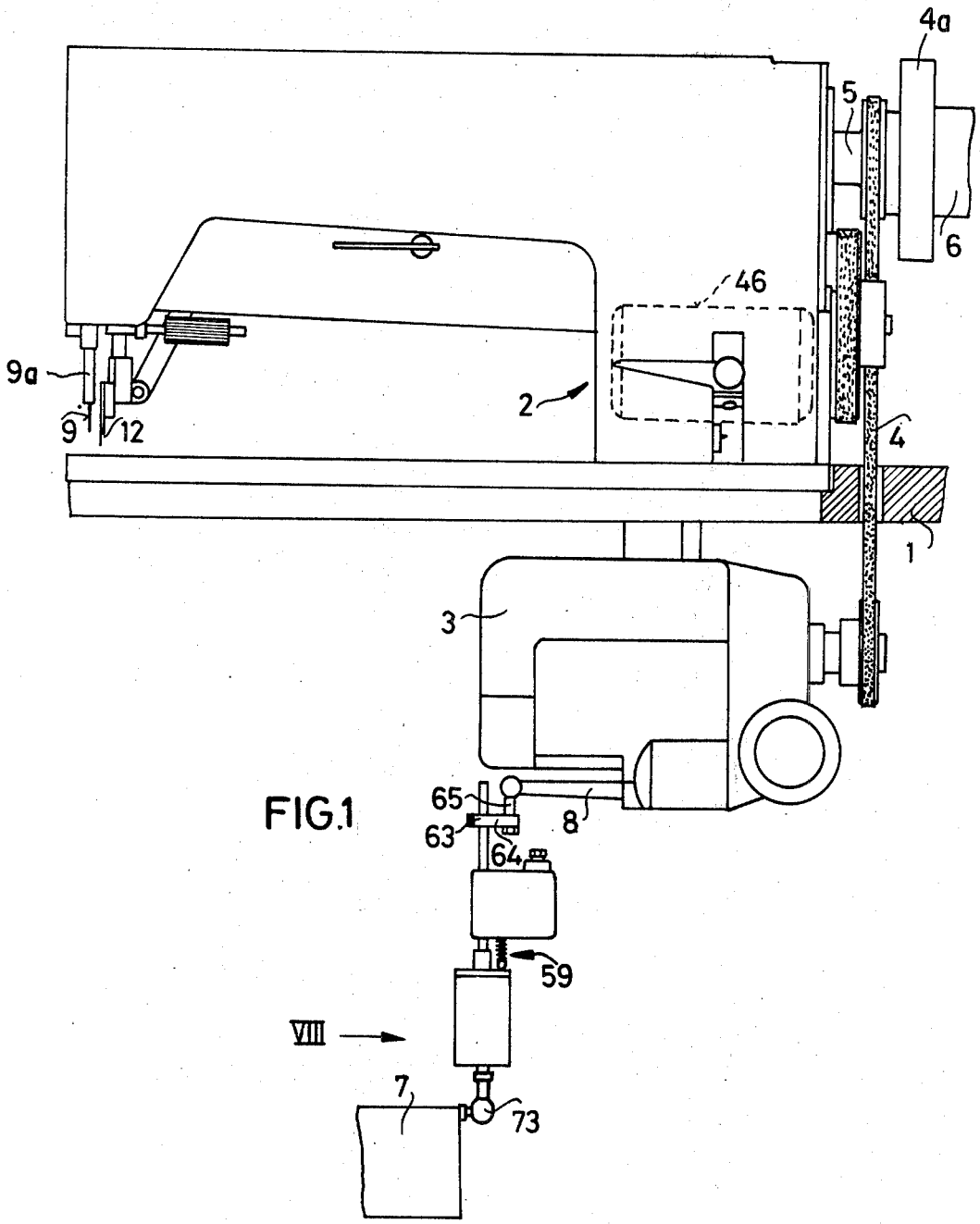
FIG. 1 is a front view of the sewing machine including the trimming mechanism according to the invention.

As obvious from FIG. 1, there is illustrated in a table plate 1 a sewing machine 2, which is driven by a stop motor 3 by means of a belt 4 and a pulley 4*a*. Said stop motor 3 cooperates with a synchronizer 6 disposed on an armshaft 5 of the sewing machine 2, and is shifted in the usual manner by a pedal 7, which acutates a lever 8. The latter causes, when moved downwardly from an inoperative position, coupling of the motor 3 to the sewing machine 2, or, when moved upwardly, turning of the armshaft 5, so that the needle bar 9*a* and the needle 9 stops in an upper or lower position.

Figure 2:
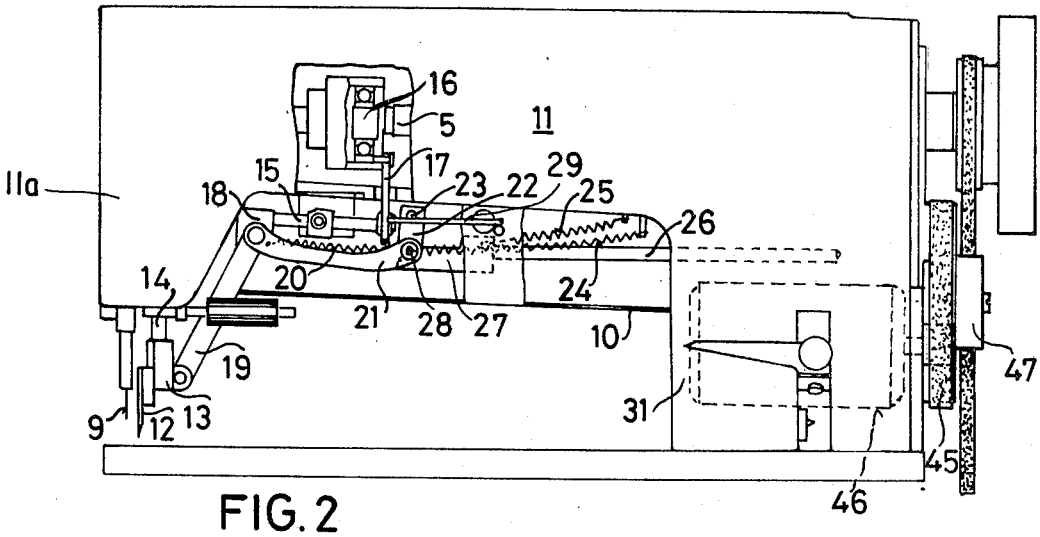
FIG. 2 is a view according to FIG. 1, showing the sewing machine partly broken away.

The trimming mechanism is accommodated substantially in a housing 10 (FIG. 2) located in the overhanging arm 11 of the sewing machine 2, and provided with a trimming blade 12, which cooperates with a counter knife 12*a* counterknife (not shown). The trimming blade 12 is secured to a guide block 13 movable on a guide rod 14 secured to the head 11*a*. The trimming mechanism is driven by a two-armed lever 15 pivoted below the overhanging arm 11 and actuated by means of a lifting eccentric 16 secured to the armshaft 5, and a connecting rod 17.

On the driven end of the arm of the two-armed lever 15 is slidably supported a shifting member 18 connected by means of a transmission rod 19 to the guide block 13. A tension spring 20 is positioned between the shifting member 18 and the connecting rod 17. Two toggle joints 21 connect the shifting member 18 with a coupling element 22, which is swingably supported about a bolt 23 located at the overhanging arm 11, and tensioned by a spring 24 supported at the arm 11.

Secured to a push rod 26 tensioned by a spring 25, is an engaging piece 27 formed with a recess, which partly surrounds a connecting bolt 28 between the toggle joint 21 and the coupling element 22. The engaging piece 27 is disengagable from the coupling element 22 by means of a rotatable release lever 29.

Figure 5:
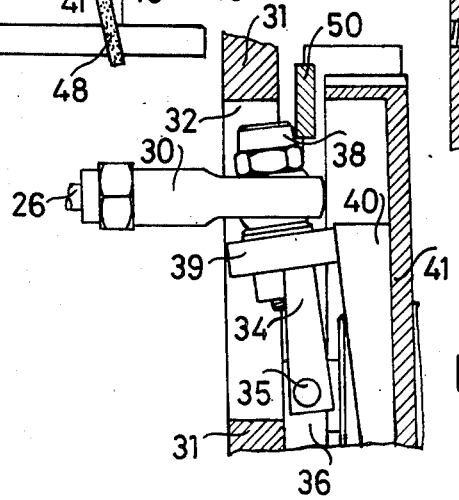
FIG. 5 is a section according to FIG. 4, showing the driving elements in a different position.
Figure 6:
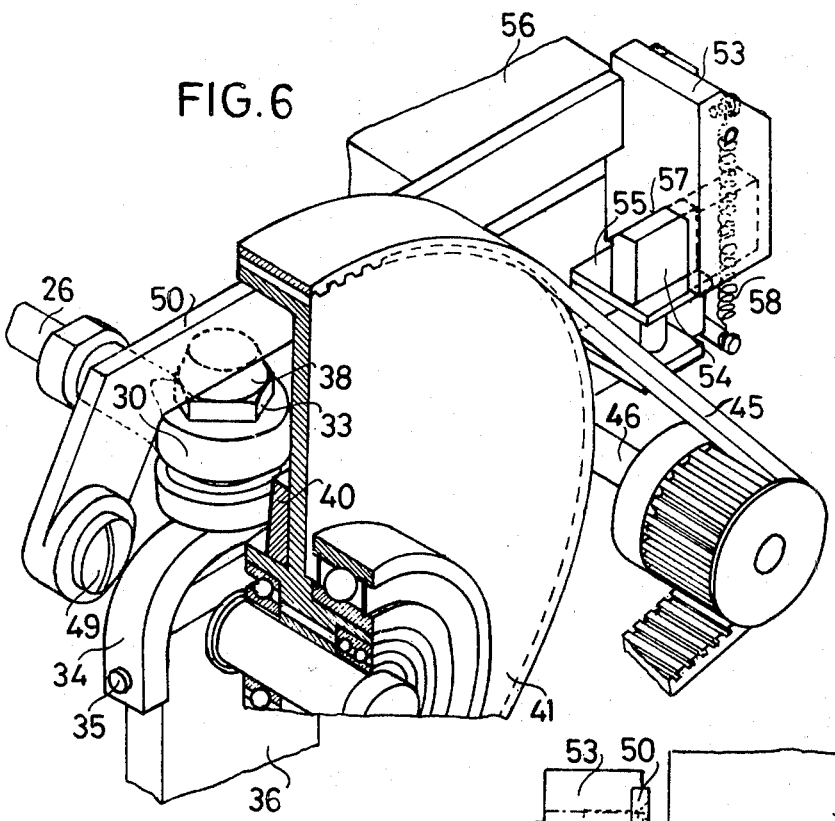
FIG. 6 is a perspective partial view of the driving elements for the trimming blade.

The free end of the push rod 26, (FIGS. 4 to 6) is provided with a link head 30 movable in a recess 32 formed in a standard 31 of the sewing machine 2, and secured to a rocking arm 34 by means of a bolt 33. The rocking arm 34 is swingably attached to a plate 36, which is secured to the standard 31 by means of screws 37. The bolt 33 is formed with a somewhat flared out head 38 and carries a roller 39.

Figure 3:
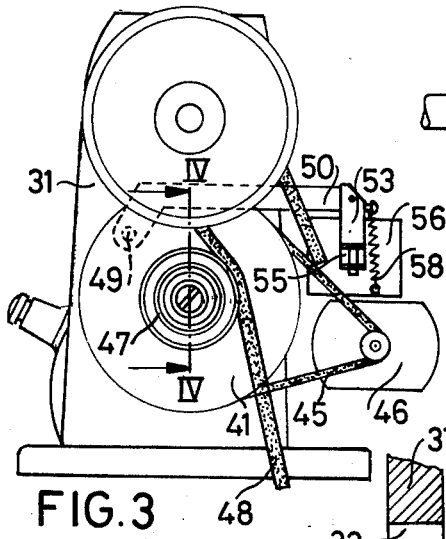
FIG. 3 is a right side view on the sewing machine.
Figure 4:
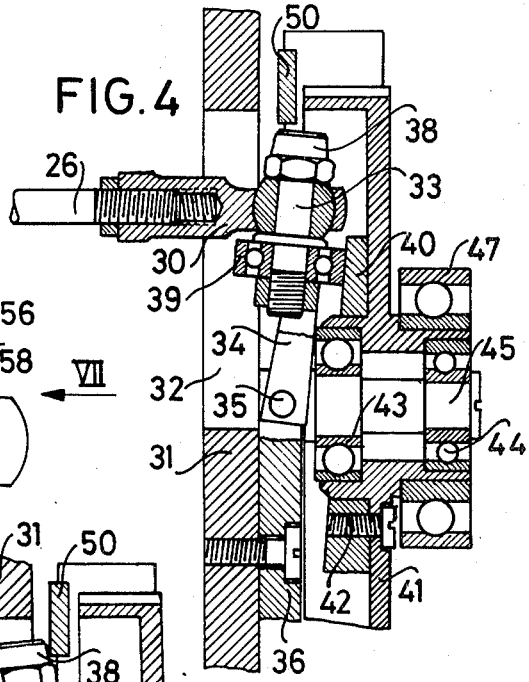
FIG. 4 is a section taken along line IV — IV of FIG. 3.

The roller 39 (FIGS. 4 to 6) is biased by the spring 25 (FIG. 2) against a plate cam 40, which is secured to a toothed belt wheel 41 by means of screws 42 (FIG. 4). The toothed belt wheel 41 is pivoted to an axle 45 inserted in the plate 36, by means of ball bearings 43, 44, and driven by a driving motor 46 (FIG. 3) by means of a toothed belt 45*a*. The driving motor 46 is disposed at the standard 31 of the sewing machine 2. Pivoted to the toothed belt wheel 41 is a guide roller 47 for the driving belt 48 of the sewing machine 2.

Figure 7:
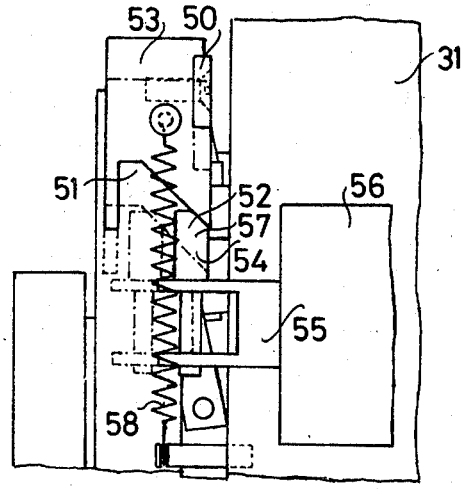
FIG. 7 is a partial view in the direction of the arrow according to FIG. 3.

Pivoted to the standard 31 by means of a shoulder stud 49, is a toggle lever 50, the free end of which is secured to block 53, which is provided with a recess 51 and a beveling 52 (FIG. 7). A shifting member 54 projects into the recess 51 and is movable in a horizontal plane together with the armature 55 of an electromagnet 56. Moreover, the shifting member 54 has a beveling 57 resting against the beveling 52 of the block 53 under the tension of a tension spring 58.

Figure 9:
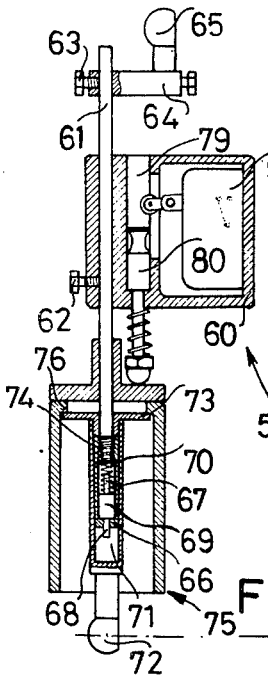
FIG. 9 are sections through the shifting device for the supplementary driving to 13 motor, showing different switching positions.

Between the lever 8 of the stop motor 3 and the pedal 7 there provided a switching device 59 (FIGS. 1 and 8 to 13) for the electromagnet 56 and the driving motor 46. The switching device 59 is accommodated in a housing 60, which is clamped to a rod 61 by means of a screw 62. The rod 61 carries at its upper end a displaceable connecting piece 64, lockable by means of a clamping screw 63. The connecting piece 64 is connected to the lever 8 (FIG. 1) of the stop motor 3 by means of a ball and socket joint 65. To the lower end if the rod 61 is screwed a tubular shifting member 66 (FIG. 9) having a bottom, and receiving against the tension of a spring 70, a slider 69 provided with two stop pins 67, 68. The shifting member 66 is displacably located in a sleeve 71, which is provided at its lower end with a ball and socket joint 72 connected to the pedal 7. Inserted in the upper part of the sleeve 71 is a second disc 73 formed with a screw connection 74, and carrying a tubular control member 75 having a lateral edge 76.

Displacably secured to the rod 61 is a first disc 78 formed with a guide sleeve 77 and bearing on the edge 76 of the control member 75.

Figure 10:
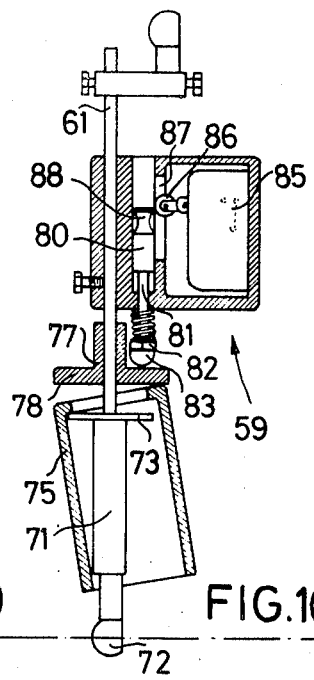
Figure 11:
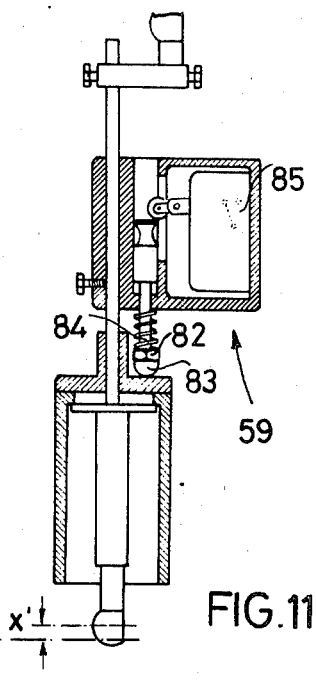
Figure 12:
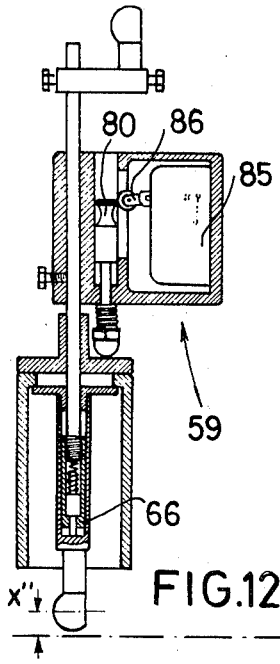
Figure 13:
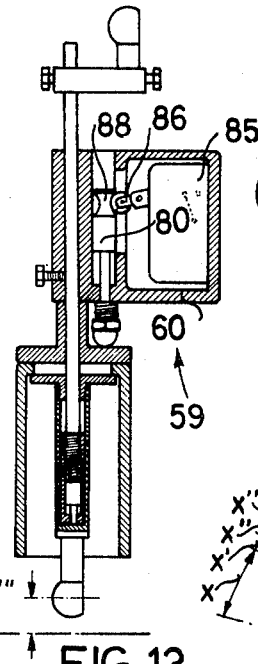
Figure 8:
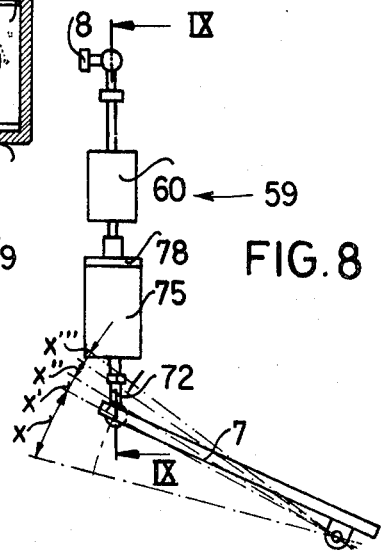
FIG. 8 shows the linkage for shifting the sewing machine drive and the supplementary driving motor for the trimming blade, seen in the direction of the arrow VII of FIG. 1.

Displacably received in a bore 79 provided in the housing 60, is a slide rod 80 (FIG. 10), which is formed with a rod 81 guided through the bottom of the housing 60. To the end of the rod 81 is screwed a spring rest 82, the hemispherical part 83 of which bears on the edge of the disc 78 without tensioning a spring 84 located between the housing 60 and the spring rest 82. In the housing 60 is arranged a switch 85, the contacts of which are in the circuit of the electromotor 46 and the electromagnet 56 of the switching device (FIGS. 3 and 6), the switching means of the switch 85 is actuated by means of a swingable roller 86 projecting through a slot 87 formed in the housing 60, into the path of motion of the slide rod 80 formed in its upper part with a groove 88 (FIG. 10).

Operation of the trimming mechanism is as follows:

By treading the pedal 7 and thus turning the footboard by a more or less large degree of angle X (FIG. 8), the sleeve 71 connected to the pedal 7, is moved downwardly, thereby driving the rod 61 and the associated parts. Consequently, the lever 8 of the stop motor 3 (FIG. 1) is operated, which in turn drives the armshaft 5 of the sewing machine 2 by means of the belt 4. By this, the lifting eccentric 16 (FIG. 2) imparts up and down motions to the connecting rod 17 which are transmitted to the double lever 15, the shifting member 18 and the trimming blade 12 by means of the links transmission rod 19 and the guide block 13. The trimming blade 12 is always operated at the moment, where the needle 9 penetrates the workpiece.

If it is desired to sew with a low speed, i.e. sections of a workpiece having roundings of a small radius, it is possible to increase the cutting sequence of the trimming blade 1 which is determined by the rate of revolutions of the sewing machine 2, by actuating the switch 85. This is effected by moving the control member 75 (FIG. 10) aside by means of the operator'foot, which causes switching on of the actuating of the switch 85 which switches on the driving motor 46 and the electromagnet 56. The armature 55 of the electromagnet is attracted and causes that the shifting member 54 (FIGS. 6 and 7) in connection with the bevelings 52 and 57 cooperating with the latter and the block, to lift the block 53, which in turn lifts the toggle lever 50. As is obvious from FIG. 5, up to this time, the lever 50 had retained the roller 39 out of the effective range of the plate cam 40. Thus, the roller 39 bears against the plate cam 40, so that additional vibratory movements are imparted upon the trimming blade 12 by means of the push rod 26, engaging piece 27, connecting bolt 28, toggle joints 21, transmission rod 19 and the guide block 13. Therefore, in order to obtain proper cutting results at low sewing speed, the trimming blade 12 performs more vibratory movements than the needle 9. After removing the foot from the control member 75, the driving motor 46 and the electromagnet 56 are switched off, whereupon the spring 58 pulls the toggle lever 50 into the path of motion of the head 38 of the bolt 33, as is obvious from FIG. 5.

For turning the workpiece about the needle 9 located in the workpiece, the trimming blade 12 can also be actuated during a standstill of the sewing machine 2 by treading the pedal 7 into the opposite direction. Thereby, after passing through the field of traverse X' (FIGS. 8 and 11) initially the lever 8 of the stop motor 3 is actuated placing the needle 9 and the trimming blade 12 into their lowest position. Then, after passing through the field of traverse X'' (FIGS. 8 and 12), the slide rod 80 actuates the switch 85, which switches on, as described above, the driving motor 46 and the electromagnet 56. After passing through the field of traverse X''' (FIGS. 8 and 13) and treading the pedal 7 into its end position, the lever 8 of the stop motor 3 switches on a thread cutting device (not shown), whereupon, as obvious from FIG. 13, the slide rod 80 lifted, so that the roller 86 of the switch 85 enters into the groove 88 of the slide rod 80, thus causing switching off of the driving motor 46 of the trimming blade 12 and the electromagnet 56. Now, the thread cutting procedure takes place while the trimming blade 12 is inoperative.

When threading the pedal 7 into its inoperative position the switch 85 is not actuated, since the roller 86 is swingably secured to the actuating arm of the switch 85, and the switch is only actuated at that moment when the slide rod 80 is moved to the top.

What I claim is:

1. In a sewing machine having a hollow standard, an overhanging arm, a head, a rotary drive shaft extending longitudinally in said arm, a combined handwheel and pulley secured to said drive shaft, a reciprocating needle bar driven by said shaft, stitch forming means, a stop motor in driving connection with said pulley and having an actuating rod, a foot treadle and connecting means between said foot treadle and said actuating rod, a trimming mechanism including a trimming blade adjacent to said needle bar, a stationary counterknife cooperating with said trimmer blade, first driving means for imparting up and down motions to said trimming blade as a function of the positions of said needle bar, comprising eccentric means fastened to said rotary drive shaft driven by said stop motor, a double armed lever pivoted below said overhanding arm, a connecting rod linked to said eccentric means and one arm of said double-armed lever, a block carrying said trimming blade, a vertical guide rod receiving said block, and a transmission rod linked to said block and the free arm of said double-armed lever, and second driving means for imparting up and down motions to said trimming blade, irrespective to said first driving means consisting of a plate cam, a motor for driving said plate cam, cam follower means in engagement with said plate cam, an operating rod between said cam follower means and said first driving means and disengaging means for disconnecting said follower means from said plate cam, and control means for said motor.

2. In a sewing machine as defined in claim 1, wherein said control means for said motor driving said plate cam includes a switching mechanism arranged between said foot treadle and said actuating rod of said stop motor comprising a switch connected with said motor and said disengaging means for disconnecting said follower means from said plate cam, foot drive means for actuating said switch when said foot treadle is in the normal position or pressed downwards out of its normal position, means for actuating said switch when said foot treadle is in a second position above said normal position, and means for inoperating said switch when said foot treadle is brought into a third position above said normal position and during returning of said foot treadle into its normal position.

3. In a sewing machine as defined in claim 1, wherein said second driving means further includes a plate secured to the standard of the sewing machine, an axis secured to said plate, a toothed belt wheel carried by said axis and carrying said plate cam an U-profiled rocking arm pivoted to said plte, a bolt inserted into said rocking arm and having a flared out head, a link head secured to said operating rod and carried by said bolt and a spring for bearing said cam follower means against the profile of said plate cam, and said disengaging means for disconnecting said follower means from said plate cam comprises a toggle lever pivoted to said standard of said sewing machine and swingable into the path of motion of said head of said bolt, a block secured to the free end of said toggle lever and having a recess provided with a beveling, an electromagnet controlled by said control means for said motor and having an armature, a shifting member carried by said armature and provided with a beveling cooperating with said beveling of said recess being in said block, and a tension spring for holding said block in connection with said shifting member.

4. In a sewing machine as defined in claim 2, wherein said switching mechanism further comprises a housing for receiving said switch and provided with a feed bore and a passing through bore, a rod linked to said actuating rod of said stop motor and carrying said housing and having a screw thread at its free end, a screw for securing said housing to said rod received in said passage through bore, actuating means for said switch including a slide rod provided with a groove and received in said feed bore, a roller mechanism on said switch and cooperating with said slide rod and said groove causing an operation of said switch only when moving said slide rod in one direction, a hemispherical part secured to the end of said slide rod, a spring on said slide rod between said housing and said hemispherical part, and said foot drive means for actuating said switch includes a first disc slidably received on said rod and cooperating with said hemispherical part of said slide rod, a second disc slidably received on said rod below said first disc and provided with a screw thread, a sleeve screwed to said screw thread of said second disc and provided with an upper stop pin and a lower stop pin passing through the bottom of said shifting member for cooperating with the bottom of said sleeve, a spring within said shifting member and between said rod and said slider and a control member consisting of a cup-shaped cylindrical part having a lateral edge and arranged between said first disc and said second disc.

* * * * *